US005720215A

United States Patent [19]

Asplund et al.

[11] Patent Number: 5,720,215

[45] Date of Patent: Feb. 24, 1998

[54] AUTOMOTIVE AIR CONDITIONING COMPRESSOR PISTON WITH ECCENTRIC ANTI ROTATION PAD

[75] Inventors: David Jared Asplund, Lockport; David Michael Ebbing, Clarence Center, both of N.Y.

[73] Assignee: General Motors Corporation, Detroit, Mich.

[21] Appl. No.: 755,750

[22] Filed: Nov. 25, 1996

[51] Int. Cl.[6] ..... F04B 27/08

[52] U.S. Cl. ..... 92/71; 92/165 R

[58] Field of Search ..... 417/269, 222.1, 417/222.2; 92/71, 165 R

[56] References Cited

U.S. PATENT DOCUMENTS 4,963,074 10/1990 Sanuki et al. ..... 417/222

FOREIGN PATENT DOCUMENTS 62-133973 8/1987 Japan .

4-49676 4/1992 Japan .

8-109874 10/1994 Japan .

6-346844 12/1994 Japan .

*Primary Examiner*—Richard E. Gluck

*Attorney, Agent, or Firm*—Patrick M. Griffin

[57] ABSTRACT

A piston (40) for use in a compressor housing (10) having a cylindrical inner surface (12) with an anti rotation wing (42) of improved design. The outer surface of the piston anti rotation wing (42) includes a pair of spaced, semi cylindrical pads (48), each with a radius substantially equal to the compressor housing inner surface (12). Each pad (48) is located on the anti rotation wing (42) such that, when the winG (42) is centered, the inner edge of each pad (48) is radially spaced slightly from the housing inner surface (12), and each pad is eccentric relative to the center of the compressor housing surface (12). When the anti rotation wing (42) turns in either direction, one pad (48) or the other contacts the housing inner surface (12) concentrically, making continuous supporting contact.

3 Claims, 5 Drawing Sheets

AUTOMOTIVE AIR CONDITIONING COMPRESSOR PISTON WITH ECCENTRIC ANTI ROTATION PAD

TECHNICAL FIELD

This invention relates to a piston for use in an automotive air conditioning compressor which has an anti rotation wing of improved design.

BACKGROUND OF THE INVENTION

Piston type air conditioning compressors have a housing with a cylindrical inner surface defined about a central axis, which contains a cylinder block. The cylinder block includes a series of cylindrical bores arrayed about the central axis, each of which contains a piston. Each piston has an individual axis that is parallel to the central axis, and all of the piston axes lie on a common circle. Each piston reciprocates within a respective bore and, without some limiting means, could rotate or twist freely within its bore. The back of each piston is joined to a nutating drive mechanism, generally either a wobble plate or a swash plate, which drives each piston axially back and forth within its bore over a defined stroke. With most wobble plate designs, the piston head is driven by a rod that has a spherical bearing at each end, so there is no particular need to limit the twisting of the piston within its bore. There is such a need with a swash plate driven piston, however.

A typical prior art compressor having swash plate driven pistons is shown in FIG. 1. A compressor housing indicated generally at 10 has a cylindrical inner surface 12 surrounding a cylinder block 14. Block 14 contains a series of cylinder bores 16 arranged around a central axis A. A central drive shaft 18 rotates a fixed and slanted swash plate 20, the edge of which nutates axially back and forth over a defined stroke. Each piston, indicated generally at 22, is concurrently driven back and forth within its respective bore 16. Each piston 22 has a socketed notch 24 at the rear thereof that fits over the edge of swash plate 20 on a pair of half ball shoes 26 that allow the swash plate edge to both slide freely and twist through the notch 24 as the piston 22 is driven back and forth. This sliding and twisting action can impose a twisting force on piston 22 causing it to turn about its own axis within bore 16, indicated at Pa. Unlike wobble plate driven pistons, there is a need to limit this rotation in a swash plate design. With excessive piston turning, the notch 24 can collide with and be worn excessively by the edge of swash plate 20.

Several schemes have been proposed for limiting piston turning to prevent swash plate contact, most of which are not particularly practical, and which also present wear problems of their own. One proposal involves ribs on the pistons that ride in matching grooves in the compressor housing (or vice versa), which limits rotation well, but would entail a significant and expensive change in both the basic piston and housing structure. An example may be seen in Japanese Patent Document 4-49676 (1992). Another somewhat simpler proposal provides flats on the back of the pistons that ride along matching flats on the compressor housing, as seen in Japanese Patent Document 62-133973 (1987). While the flat to flat arrangement would be somewhat easier to machine than a rib and a groove, it still requires an alteration of the basic compressor housing inner surface, which is ideally a simple cylinder. It is not cost effective, in fact, to make the inner surface of the compressor housing anything but a simple cylinder. A preferable anti rotation device, therefore, has been a semi cylindrical wing on the back of the piston, which rides closely along the cylindrical inner surface of the compressor housing. The entire outer surface of the wing comprises a semi cylinder that is concentric to the inner surface of the housing. When the two surfaces also have nearly the same radius, in addition to being concentric, then they conform so closely that very little rotation of the piston about its own axis is possible. No alteration of the already cylindrical inner surface of the compressor housing is needed. An example may be seen in U.S. Pat. No. 4,963,074 to Sanuki et al, in FIG. 11 at 557. Oddly enough, this particular reference describes the semi cylindrical wing 557 as having a different function, but it would certainly provide anti rotation as well.

An inherent drawback of the semi cylindrical wing just described is the fact that its outer surface would rub directly along the compressor housing inner surface essentially continually, which presents a significant drag on the piston's reciprocation. Ideally, there should be a small radial clearance between the two surfaces, which, while it allows a small degree of piston turning, still limits piston turning sufficiently to prevent rubbing on the swash plate edge. To create such a radial clearance, the outer surface is given an arc radius that is concentric to the compressor housing, but smaller in radius. With this design, however, a different wear problem is presented. As the piston turns slightly, an essentially sharp side edge of the wing, the edge where the cylindrical surface terminates, contacts the inner surface of the housing, which can wear a groove and cause contact noise.

Other designs show an anti rotation wing in which the wing's outer surface either does not lie on a single cylindrical surface, or at least does not lie on a single cylindrical surface that is concentric to the inner surface of the compressor housing. This basic type of anti rotation wing is shown in FIGS. 2 and 3, indicated generally at 28. The outer surface of wing 28 has a central area 30 of arbitrary, predetermined width which is flattened off, and which plays no real part in the anti rotation action, since it does not contact the housing inner surface 12. The central area 30 is bounded by a pair of side edges 32, parallel to each other and to the housing inner surface 12, which have a predetermined radial clearance therefrom when the piston wing 28 is in a centered condition. In the embodiment shown, the side edges 32 are not the terminal, outermost edges of the outer surface of the wing 28. If they were, then they would contact the housing inner surface 12 directly, and would thereby create the same sharp edge wear problem noted above. Instead, a pair of side surfaces 34 (described in more detail below) are located outboard of both side edges 32, and it is one of these that contacts the housing inner surface 12, depending on the direction of piston turning. The left side surface 34 is shown making contact in FIG. 3.

Various shapes have been proposed for these housing contacting side surfaces 34 (or their structural equivalents), none of which operates significantly better than the semi cylindrical anti-rotation wing described above. One example is Japanese Patent Document 6-346844 (1994), which shows several embodiments, although the various embodiments do not appear to share a single theme. The FIG. 7 embodiment merely cuts away the center area of the outer surface of the wing (recognizing, apparently, that it has no effect), thereby leaving two remaining, but narrower semi-cylindrical areas **14*b* at the sides. The remaining areas 14*b*** are apparently still concentric to the housing inner surface, but have a radial clearance. These, of course, would operate no differently from a standard, single surface wing, and have the same two sharp outer most edges that would make contact. Another embodiment in the same patent, FIG. 5, takes a different approach. The outer surface 25*a* of the anti rotation wing is a single radius semi-cylinder, but with a radius that is apparently supposed to be midway between the radii of the piston (which is smaller) and the radius of the housing inner surface (which is larger). While this is a different approach, it has literally nothing to do with why an anti-rotation wing works. It works, fundamentally, because the clearance of the wing edges from the inner surface of the housing is less than the clearance of the piston notch from the edge of the swash plate. What the shape of the wing is between the two edges is irrelevant. While that comparative clearance relation does hold for the outer surface 25*a* of the FIG. 5 embodiment, it is incidental to why it would work to limit piston turning. Yet another design proposes to do essentially the opposite of the FIG. 7 embodiment of the 6-346844 embodiment. That is, the surfaces corresponding to the side surfaces 34 of FIG. 3 are given a radius greater than, not smaller than, the radius of the compressor housing inner surface 12. The central area corresponding to area 30 of FIG. 3 is given an even greater radius of curvature, greater than either the housing inner surface 12 of the side surfaces 34. Again, the shape of the central area 30 is irrelevant. Further, the side surfaces 34, even with a larger radius than the housing inner surface 12, would still basically make a sharp side edge contact with the compressor housing inner surface 12, even if they were rounded off slightly. To summarize, the problem of sharp edged wear upon contact of the anti rotation wing is not significantly improved by any of the designs described above.

SUMMARY OF THE INVENTION

An automotive air conditioning compressor piston in accordance with the present invention is characterised by the features specified in claim 1.

In the preferred embodiment disclosed, a typical compressor housing, piston block and shaft driven swash plate are provided. Each cylinder bore contains a piston which reciprocates about its own axis, parallel to the central compressor housing axis. A socketed notch in each piston rides over the edge of a shaft driven swash plate, supported for free sliding and twisting. An anti rotation wing at the back of each piston rides back and forth with the reciprocating piston, near the cylindrical inner surface of the compressor housing. The outer surface of the anti rotation wing has a pair of spaced side edges, parallel to each other and to the inner surface of the compressor housing, with a flattened off center area between the side edges. When the anti rotation wing is in a neutral, centered position relative to the compressor housing inner surface, each side edge is spaced from the inner surface by a predetermined, equal radial clearance. The radial clearance is sufficiently small so that either side edge can make contact with the inner surface of the compressor housing well before the piston notch will make contact with the edge of the swash plate.

The side edges are not the terminal edges of the anti rotation wing, however. Instead, each side edge is bounded by a semi cylindrical pad integral to and outboard of its respective side edge. Each pad has a radius of curvature basically equal to the inner surface of the compressor housing. When the anti rotation wing is centered, the semi cylindrical pads are not concentric to the inner surface of the compressor housing, however. Instead, their arcuate surfaces fall away from the compressor housing surface to a small degree, with a center point offset from the central axis of the compressor housing. The degree of non concentricity between each semi cylindrical pad and the compressor housing inner surface is sufficient to assure that when the anti rotation wing does rotate out of its centered position far enough for either side edge to contact the compressor housing surface, the semi cylindrical pad outboard of that side edge contacts the compressor housing inner surface as well, closely conforming thereto because of the equal radii. In the contact position, the pad's center of curvature does coincide with the central axis of the compressor housing. This close and continuous mutual contact between pad and housing inner surface assures a large area of bearing support, with consequently less wear and noise.

DESCRIPTION OF THE PREFERRED EMBODIMENT

Figure 1:
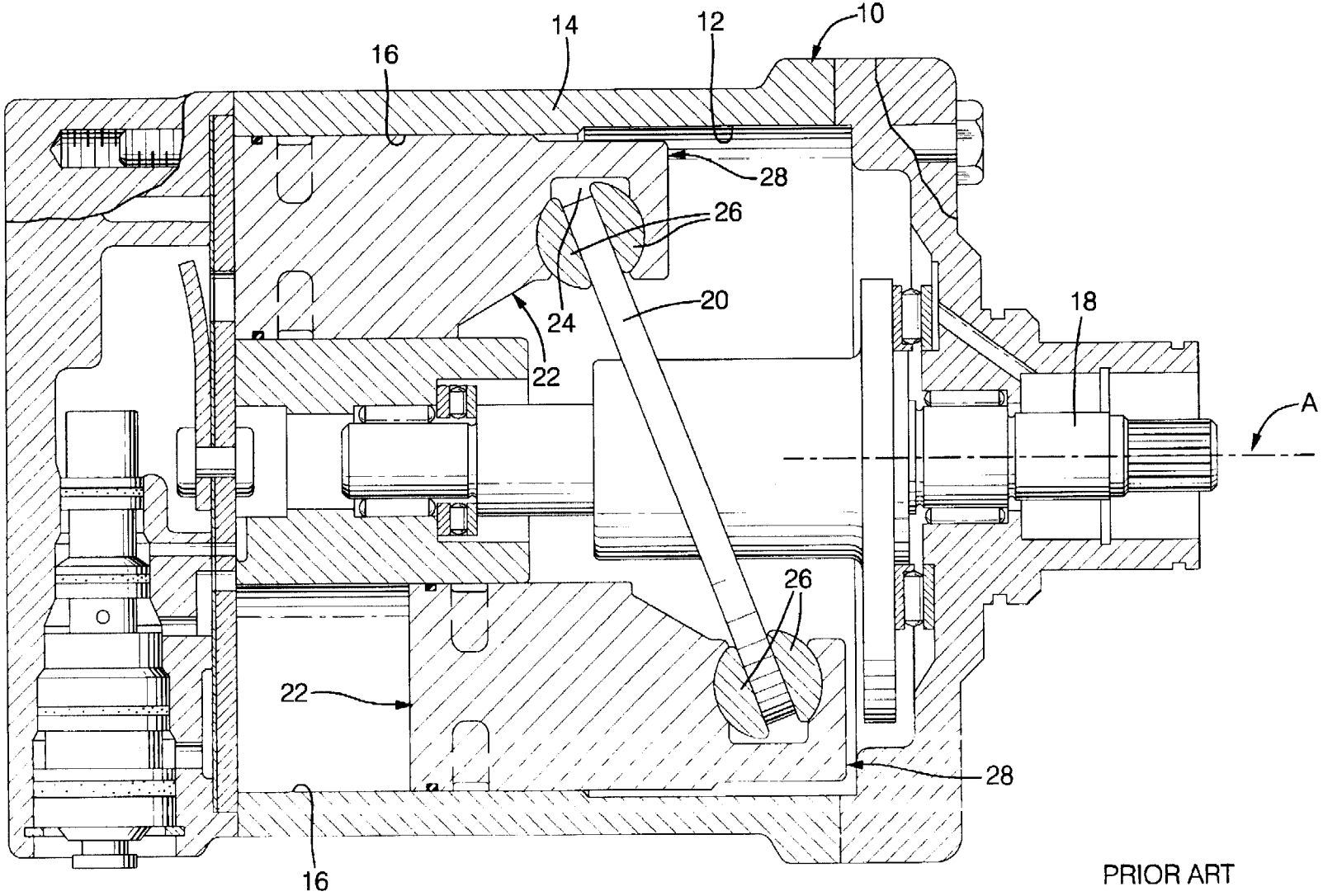
PRIOR ART FIG. 1
FIG. 1 is a cross section through a prior art compressor housing, cylinder block, and a pair of pistons, showing the swash plate and drive shaft in elevation.
Figure 2:
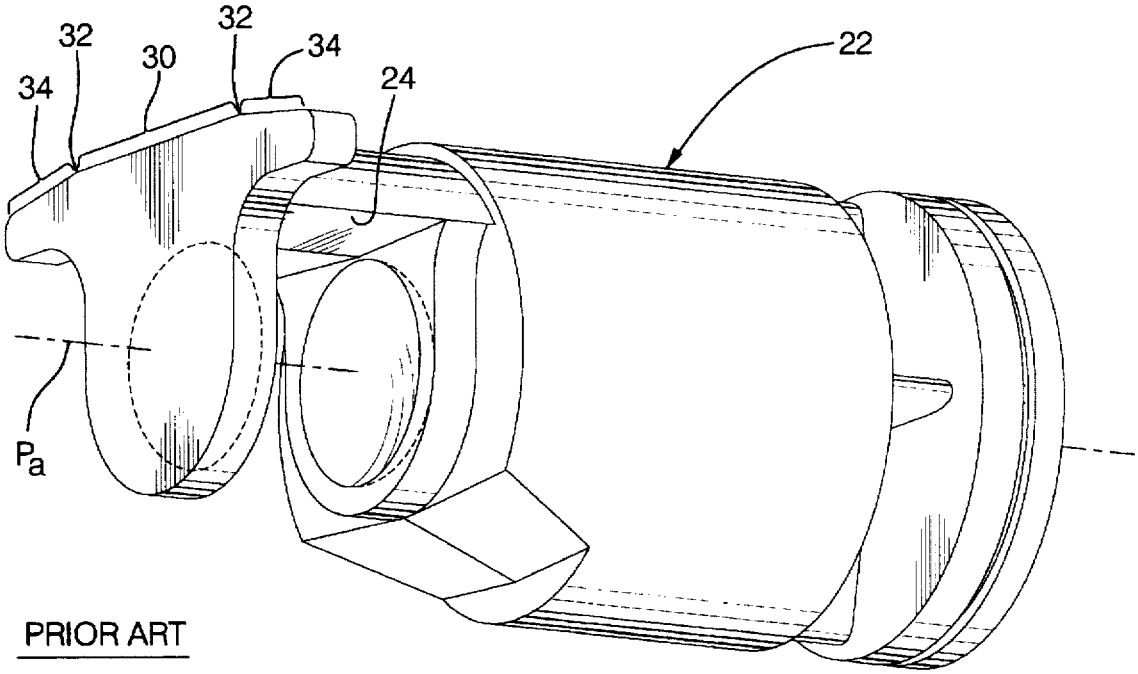
PRIOR ART FIG. 2
FIG. 2 is a perspective view of a single prior art piston.
Figure 3:
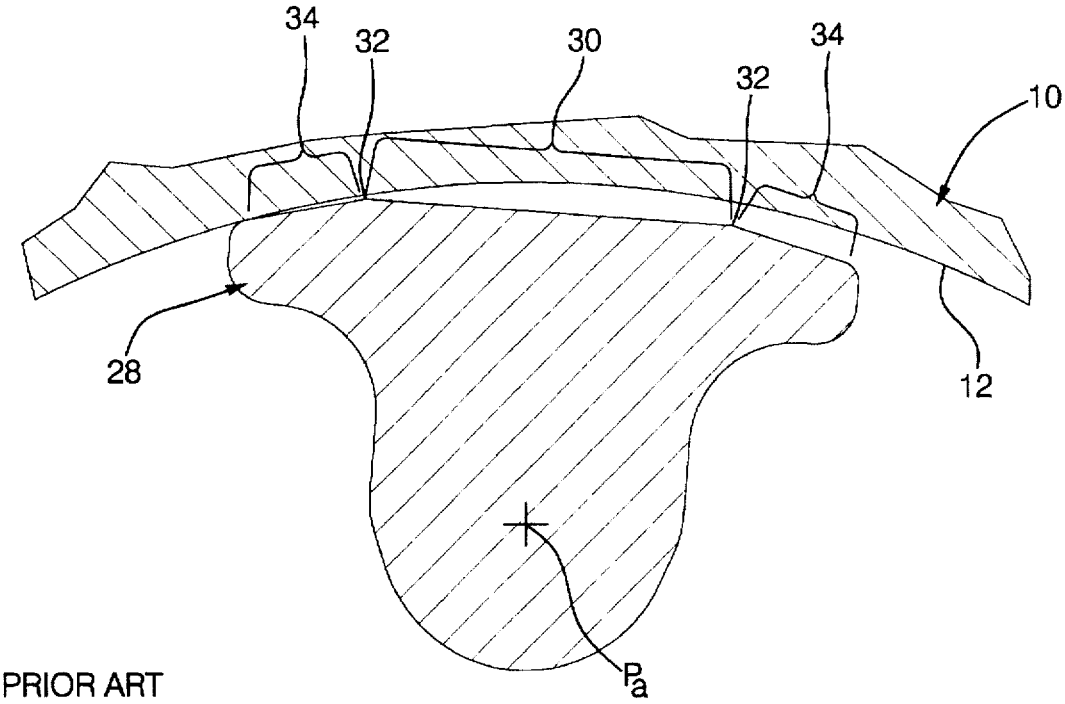
PRIOR ART FIG. 3
FIG. 3 is an enlarged cross section through the anti rotation wing of the piston of FIG. 2, showing a portion of the inner surface of the compressor housing.
Figure 4:
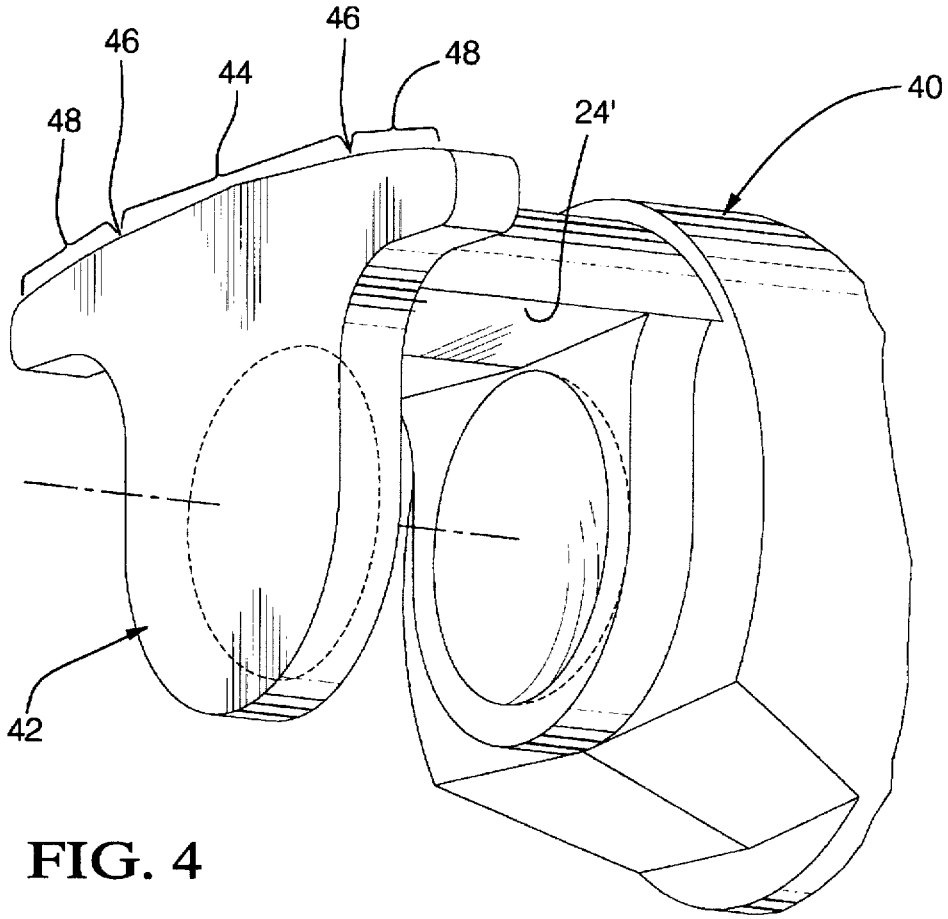
FIG. 4 is a perspective view of the back of a preferred embodiment of a piston made according to the invention.

Referring first to FIG. 4, a preferred embodiment of a piston made according to the invention is indicated generally at 40. Piston 40 is used in conjunction with the same compressor housing 10 with the same radius inner surface 12, cylinder block 14, bores 16, shaft 18 and swash plate 20. Piston 40 is the same basic size, length, material and weight as piston 22 described above, and has the same socketed notch, indicated at 24', which fits over the edge of swash plate 20. The back of piston 40 has an anti rotation wing, indicated generally at 42, which, in general size and location, is very similar to the anti rotation wing 28 described above. The operative portion of wing 42, however, which is its outer surface, is significantly different in shape. The center area 44 of the wing outer surface is basically flat, specifically a very shallow V shape, with a radial width of approximately 18 mm. The width of the center area 44 is fairly arbitrary, but would not be a great deal larger than the radius of the piston 40 in any particular case. The center area 44 is bounded by a pair of imaginary side edges 46, parallel to one another and to the housing inner surface 12. The side edges 46 are imaginary in the sense that they are an arbitrary dividing lines between the center area 44 and a pair of semi cylindrical pads 48 that lie outboard of the center area 44, but are important in defining the shape and operation of the pads 48, described below.

Figure 5:
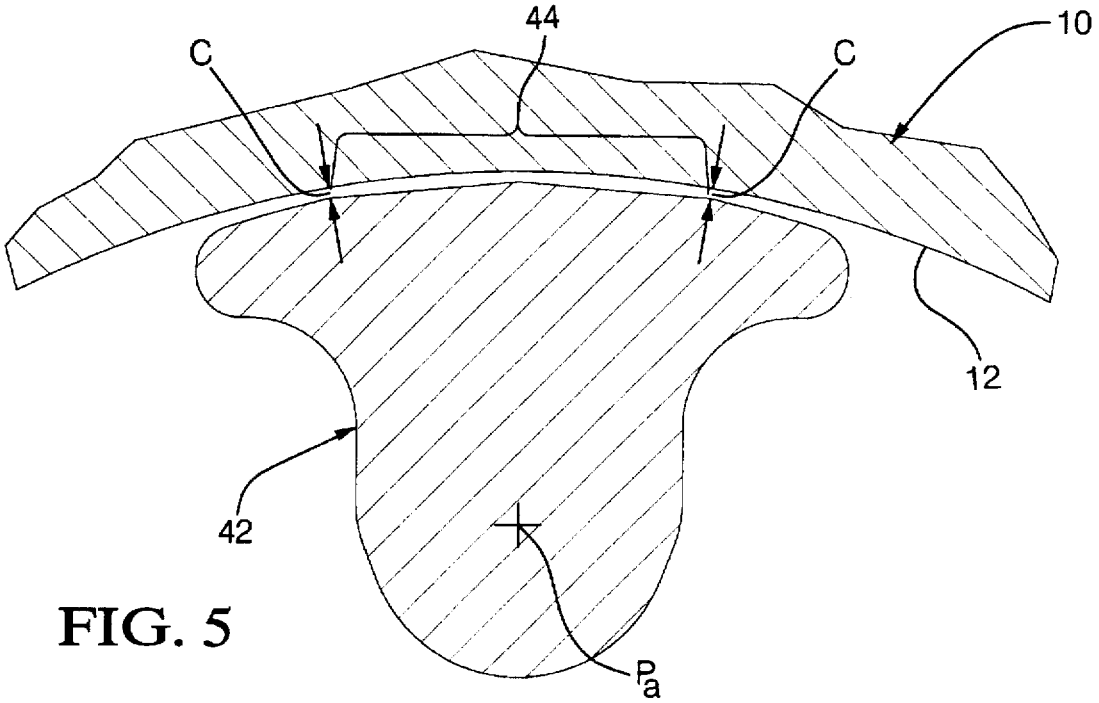
FIG. 5 is an enlarged cross section through the anti rotation wing of the piston of FIG. 4 in a neutral, centered position, showing a portion of the inner surface of the compressor housing.

Referring next to FIG. 5, piston 40 and wing 42 are shown in a neutral or centered position, where a radial plane bisecting the wing 42 and passing through the piston axis Pa also passes through the housing central axis A. The side edges 46 are a useful construct in that they establish an important neutral position radial clearance "c" from the housing inner surface 12. In the neutral position, the radial clearance between the outer surface of the wing 42 and the compressor housing inner surface 12 is symmetrical and even at every corresponding point. The clearance "c" is the most significant, however, in that it is the smallest radial clearance outboard of the center area 44, and will be the first "point" (line, in fact) to hit the housing inner surface 12 when the piston 40 turns in either direction. Here, the clearance "c" is quite small, about 4 mm, but that will vary from case to case. Fundamentally, the clearance "c" need only be chosen to be small enough to contact the housing inner surface 12 before the notch 24' hits the edge of the swash plate 20. As a practical matter, however, the actual clearance "c" will typically be chosen to be far smaller than that fundamental upper clearance limit. This assures that the rotation limiting contact will occur along before collision with the swash plate 20, and before significant angular momentum has been acquired by the rotating piston 40. Here, the clearance "c" is closed out after the wing 42 has rotated only about 4 degrees in either direction. The pads 48 are semi cylindrical, which, in a two dimensional drawing, is represented by two circular arcs, each subtending, in the embodiment disclosed, approximately four degrees. It bears repeating, at this point, the list of possible prior art shapes and geometrical relationships for the circular arcs that represent the pads 48, as described above. These include, one, circular arcs that are both equal in radius to, and concentric to, the housing inner surface 12. These would provide a large area of constant bearing contact, but also continual friction. Two, the circular arcs could be concentric to, but smaller in radius than, the housing inner surface 12, which leaves a radial clearance to reduce rubbing. Three, the circular arcs could be smaller in radius than, and not concentric to, the housing radius surface 12. Fourth, the circular arcs could be larger in radius than, and not concentric to, the housing radius surface 12. The latter three possibilities, as noted above, all eliminate the constant rubbing of the first possible configuration, but all create line contact, or at best a very narrow ridge of contact, with consequent wear and noise. While this is a seemingly exhaustive list of possible geometric possibilities, the invention does provide an alternative, which also improves performance.

Figure 8:
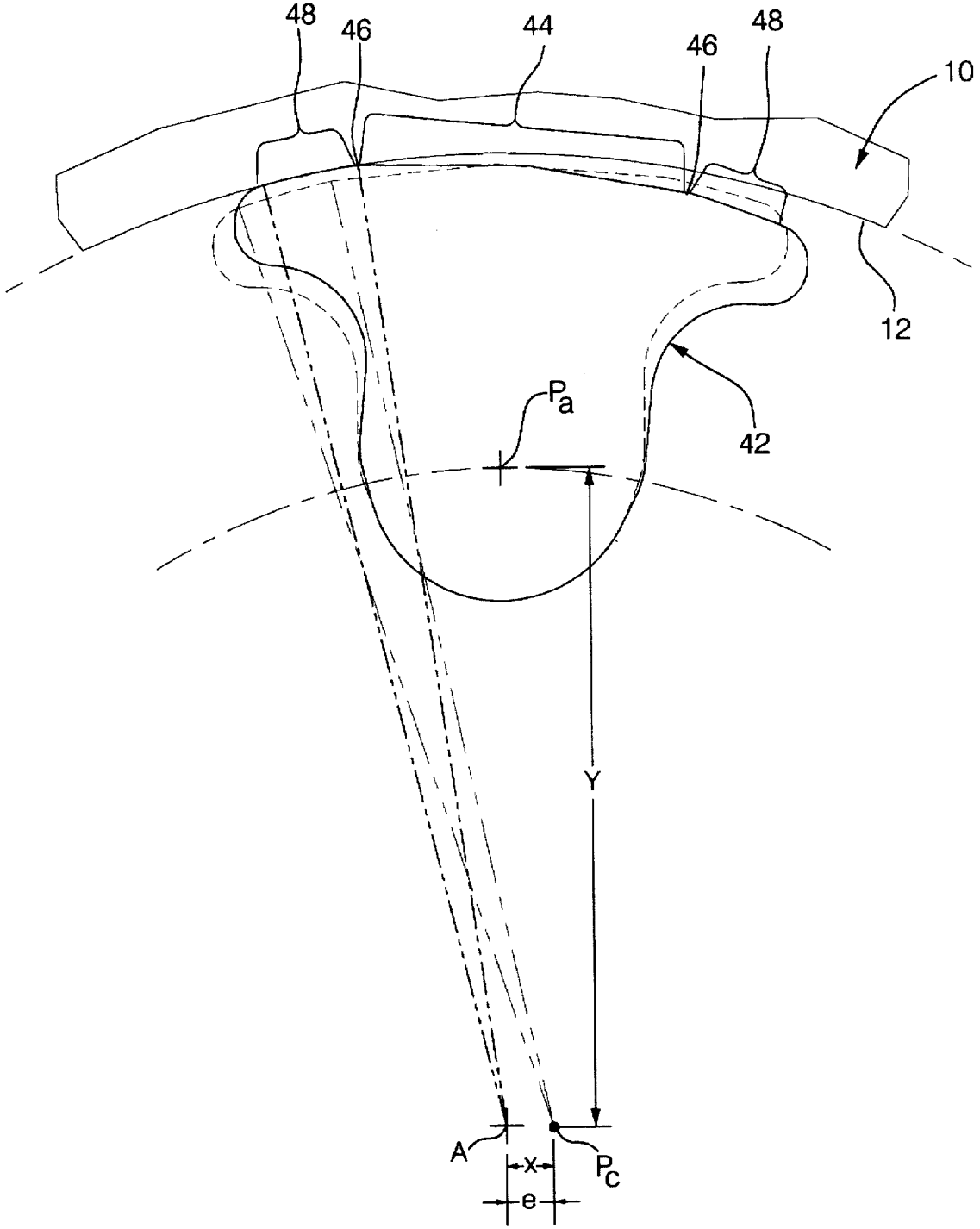
FIG. 8 is a schematic view of the anti rotation wing and inner surface of the compressor housing, showing the basic geometrical relationship of the central axis of the compressor housing inner surface and the center of the semi cylindrical pad of the anti rotation wing.

Referring next to FIG. 8, the basic geometrical shape and theory of the cylindrical pads 48 are illustrated. Only the left pad 48 is shown, but the right pad 48 is a symmetrical, mirror image of it. The circular arcs that represent the pads 48 are substantially equal in radius to the housing inner surface 12, which, in the embodiment disclosed, is approximately 25.4 mm. The radius of housing inner surface 12 could, of course, be any value desired. However, when the wing 42 is in the neutral position shown by the dotted lines in FIG. 8, the pads 48 are not concentric to the housing inner surface 12 central axis A. Instead, the center of the left pad 48, shown at Pc, falls to the right of A. (The center of the right pad 48 would fall equally to the left) The arc that represents the pad 48, therefore, falls away from the circle that represents the housing inner surface 12. The degree of eccentricity indicated at "e" is carefully chosen so that, when the piston wing 42 rotates clockwise far enough for the side edge 46 to close out the clearance "c", the pad 48 simultaneously contacts the housing inner surface 12. Because of the matching radius of the pad 48, it makes close, continuous contact with the housing inner surface 12 over its entire arc width, with benefits described below. To assure that the pad 48 makes this simultaneous contact, it has to be located properly relative to the side edge 46, with the right degree of eccentricity "e" of the pad center point Pc relative to the axis A. One way of assuring this in two dimensions is to establish a reference frame, such as the dotted vertical line drawn between the center axis Pa of the piston 40 and center axis A of housing surface 12. Then, the eccentricity "e" is resolved into components in that reference frame. As illustrated, those two components are a vertical distance ("Y") from Pa measured along the dotted vertical line and a horizontal distance ("X") from A, measured perpendicular to the dotted vertical line. Here, given the small degree of rotation necessary to close out the clearance "c", the distance "e" is almost horizontal itself, and essentially coincides with the X component. An arc with the same radius as housing inner surface 12, and also having the center point Pc so established, will then be in the proper location in two dimensional space. For the embodiment shown, with the values for "c", for the width of center area 44, and for the radius of housing inner surface 12 noted above (which are, of course, case specific), those Y and X distances are approximately 34 mm and 2.5 mm respectively. However, a mathematical solution and calculation of those distances cannot be established by conventional algebra, and requires complex numerical methods. Therefore, a far simpler approach would be simply to replicate the computer drawing of FIG. 8 for the specific case, that is, incorporating to scale the desired values for the width of wing center area 44, for the clearance "c", for the radius of housing inner surface 12, and for the location of Pa, as shown by the dotted lines with the shape of wing 42. The pads 48 would not be drawn in at first, so the wing 42 would terminate at the side edges 46. Then, rotate the wing 42 until the clearance "c" is closed out, that is, until either side edge 46 moves in line with the circle representing the housing inner surface 12, as shown by the solid lines. Then, draw in a circular arc just outboard of the side edge 46, of any desired arcuate width, which is concentric to A, as shown by the darker dotted line pie shape. Finally, rotate the wing 42 back to the neutral position, while keeping the side arc in the same relation to the wing 42, as shown by the lighter dotted line pie shape. This moves the center point Pc of the pad 48 to the eccentric position shown relative to A, and the appropriate X and Y distances can be measured off for that specific case.

Figure 6:
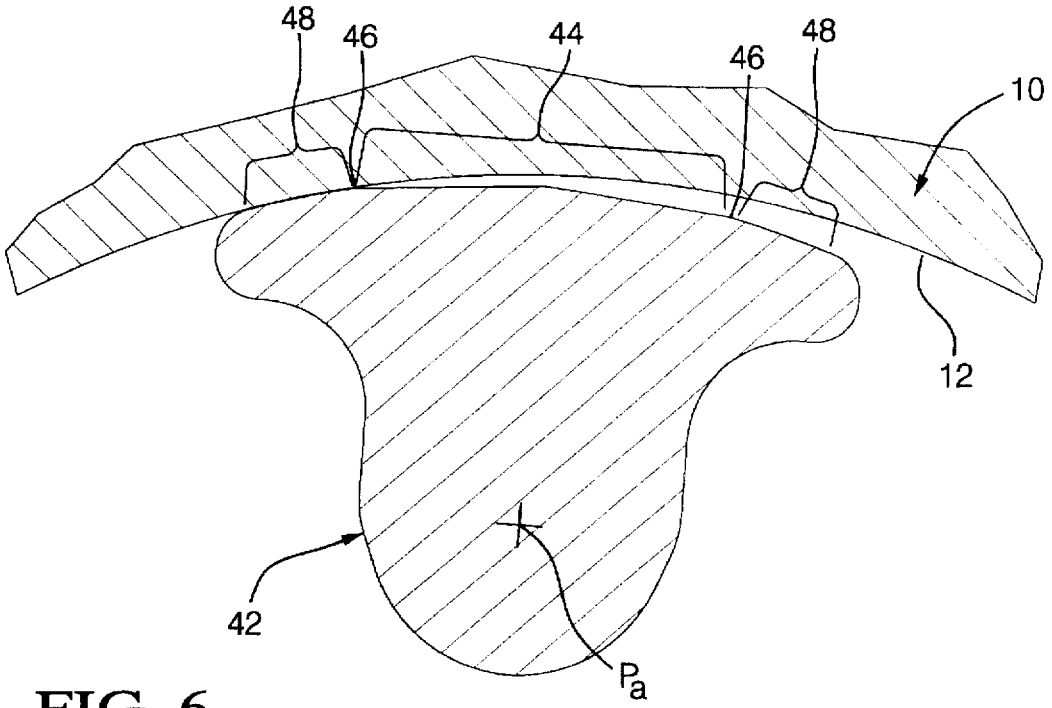
FIG. 6 is a view similar to FIG. 5, but showing the anti rotation wing turned clockwise far enough to contact the inner surface of the compressor housing.
Figure 7:
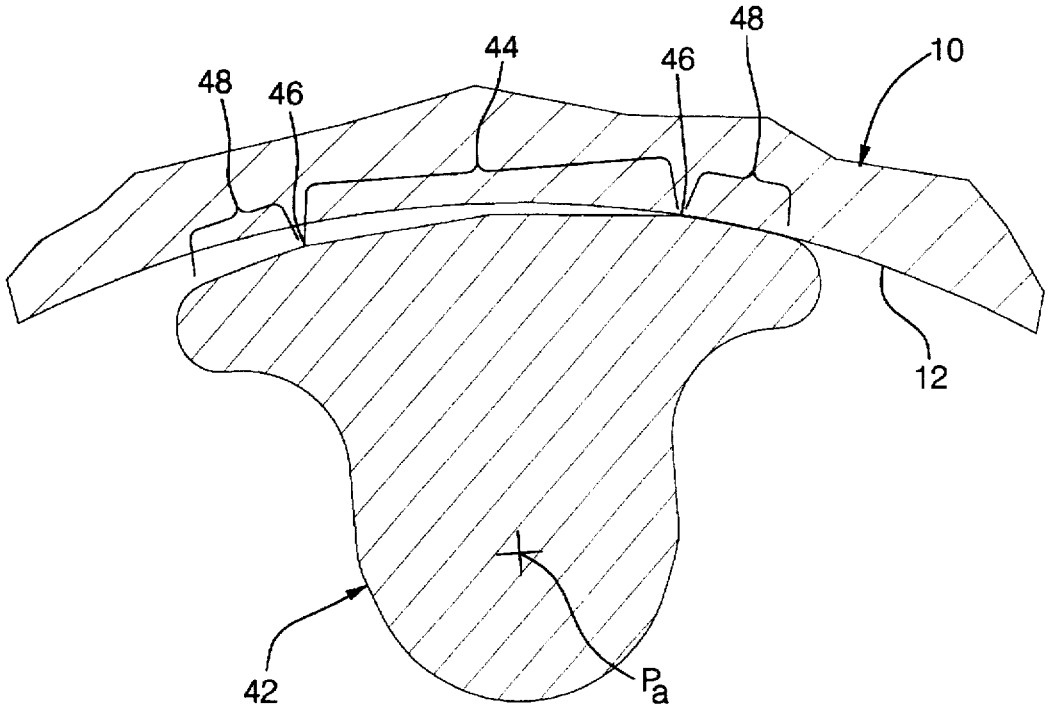
FIG. 7 is a view similar to FIG. 6, but showing the anti rotation wing turned counterclockwise into a contacting position.

Referring next to FIGS. 6 and 7, the operation of the wing 42 is illustrated. As shown in FIG. 6, if the piston 40 and wing 42 turn far enough counterclockwise, the left hand side edge 46 and left hand pad 48 make simultaneous contact with the housing inner surface 12. "Far enough" in this case is only about four degrees, as noted above. The side edge 46 makes "line contact" with the housing inner surface 12 in the geometric sense only, since it is effectively integral to the pad 48. The pad 48 makes close contact with the housing inner surface 12 over its entire arc width, not just along a sharp edge or narrow ridge. This larger load bearing contact area reduces wear and noise, and is similar if effect to the complete contact provided by the old, completely conforming anti rotation wing. However, the rubbing contact is not continual, as with the old design, and ceases once piston 40 and wing 42 rotate even slightly back clockwise toward the neutral position. When rubbing does occur, it exists only over the relatively small arcuate width of pad 48, which is about four degrees here. Still, even four degrees of arc or radial width represents far more area than a single sharp edge. FIG. 7 illustrates how the other pad 48 makes identical supporting contact with clockwise rotation.

Variations in the disclosed embodiment could be made. The wing 42 need not be at the very rear of piston 40, but could, for example, sit directly over the notch 24'. A pad 48 on only one side of wing 42 could be used, if most of the contact were expected only on that one side. Or, the arc width of the pad 48 could be made greater on the side where most of the contact was expected. While each pad should have the same radius and same basic location relative to the axis A, there is no requirement that they have the same arc width or radial width. Once the center points Pc of the pads 48 are established, as noted above, they are simple to machine, being simple semi cylinders, and could be cast or forged to near net shaped before machining. Again, the center area 44 could be any shape, or even cut out completely, so that the pads 48 would be defined entirely by the side edges 46 and the circular arcs as described. Therefore, it will be understood that it is not intended to limit the invention to just the embodiment disclosed.

We claim:

1. A piston (40) for use in a compressor housing (10) with a central axis and a cylindrical inner surface (12) defined about said central axis and a cylinder block (14) having a series of cylinder bores (16) arrayed around said central axis, each bore (16) containing a piston (40) reciprocable therewithin about a respective piston axis parallel to said central axis, said piston (40) also having an anti rotation wing (42) thereon located outside of said bore (16) with a side edge (46) parallel to said piston axis and having a predetermined clearance from said housing inner surface (12) sufficiently small for said side edge (46) to make line contact with said housing inner surface (12) as said piston rotates within said bore (16) about said piston axis to limit piston rotation, characterised in that;

said anti rotation wing (42) further includes at least one partially cylindrical pad (48) integral to and outboard of said side edge (46) having a radius of curvature substantially equal to said housing inner surface (12) and oriented eccentrically relative to said housing inner surface (12) with a degree of eccentricity sufficient to assure that as said piston wing (42) rotates to make contact with said housing inner surface (12), said pad (48) makes substantially complete contact with said housing inner surface (12) simultaneously with said side edge (46), whereby rubbing wear between said piston anti rotation wing (42) and housing inner surface (12) is substantially reduced.

2. A piston (40) according to claim 1, further characterised in that, said anti rotation wing (42) has two spaced side edges (46) and a partially cylindrical pad (48) integral to and outboard of each side edge (46).

3. A piston (40) according to claim 2, further characterised in that each partially cylindrical pad (48) has a substantially equal radial width.

* * * * *